US008859940B2

(12) United States Patent
Shimura

(10) Patent No.: US 8,859,940 B2
(45) Date of Patent: Oct. 14, 2014

(54) IMAGE HEATING APPARATUS

(75) Inventor: Yasuhiro Shimura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 186 days.

(21) Appl. No.: 13/166,106

(22) Filed: Jun. 22, 2011

(65) Prior Publication Data

US 2012/0000897 A1 Jan. 5, 2012

(30) Foreign Application Priority Data

Jul. 1, 2010 (JP) ..... 2010-151148

(51) Int. Cl.
*G03G 15/20* (2006.01)
*H05B 1/02* (2006.01)
*G03G 15/00* (2006.01)

(52) U.S. Cl.
CPC ..... *H05B 1/0241* (2013.01); *G03G 15/2078* (2013.01); *G03G 15/5004* (2013.01); *G03G 2215/2035* (2013.01)
USPC ..... 219/216; 219/497; 219/483; 219/486; 219/519; 399/44; 399/69; 399/328; 399/330

(58) Field of Classification Search
USPC ..... 219/216, 497, 483, 486, 507, 508, 519; 399/44, 69, 328, 330
See application file for complete search history.

(56) References Cited

U.S. PATENT DOCUMENTS

| | | | |
|---|---|---|---|
| 5,229,577 | A | 7/1993 | Matsuura et al. |
| 7,630,662 | B2 | 12/2009 | Namiki et al. |
| 2010/0206865 | A1 | 8/2010 | Jaccard et al. |
| 2010/0310267 | A1 | 12/2010 | Shimura et al. |

FOREIGN PATENT DOCUMENTS

| | | |
|---|---|---|
| JP | 07-121055 | 5/1995 |
| JP | 07-199702 | 8/1995 |
| JP | 3919670 | 2/2007 |
| JP | 2007-212503 | 8/2007 |
| JP | 2010-199066 | 9/2010 |

*Primary Examiner* — Henry Yuen
*Assistant Examiner* — Amit K Singh
(74) *Attorney, Agent, or Firm* — Fitzpatrick, Cella, Harper & Scinto

(57) ABSTRACT

The image heating apparatus includes first and heat generation member, a connection state switching section switching the first and second heat generation members between a serial connection state and a parallel connection state, the connection state switching section having a first make-or-break-contact relay and a second transfer-contact relay, a drive element provided used for controlling power supplied to the first and second heat generation members, and a capacitor between a power supply path closer to the side of the first and second heat generation members rather than the first relay and a power supply path closer to the commercial power supply side rather than the drive element. The image heating apparatus can suppress an increase in noise level of a noise terminal voltage by performing power control on the heater.

5 Claims, 18 Drawing Sheets

IMAGE HEATING APPARATUS

BACKGROUND OF THE INVENTION

1. Field of the Invention

The present invention relates to an image heating apparatus for use in an image forming apparatus such as a copying machine and a laser beam printer.

2. Description of the Related Art

An image heating apparatus for use in an image forming apparatus for heating and fixing uses a process of introducing a recording material as a material to be heated into a nip portion formed between a heating member maintained at a predetermined temperature and a pressure roller pressure-contacted with the heating member and heating the recording material while pinching and conveying the recording material. The image heating apparatus, particularly, the heating member of the image heating apparatus using a film heating process generally uses a heater with a resistance heat member formed on a substrate made of a ceramic material or the like.

When a heater with the same resistance value is used in the image heating apparatus located in an area of a 100-V commercial power supply or a 200-V commercial power supply, the maximum power suppliable to the heater in an area of the 200-V commercial power supply is four times that of the heater in an area of the 100-V commercial power supply. This is because the power supplied to the heater is proportional to the square of the voltage. The larger the maximum power suppliable to the heater, the worse the generation of a harmonic current, a flicker, and like by a heater power control such as a phase control and a wave-number control. In addition, considering a case in which the image heating apparatus causes thermal runaway, a more responsive safety circuit is required. For that reason, a heater with a different resistance value is often used in an image heating apparatus depending on the area of a 100-V commercial power supply or a 200-V commercial power supply. There has been proposed a method of switching the heater resistance value using a switch unit such as a relay as a method of implementing an image heating apparatus that can be shared in both areas of the 100-V commercial power supply and the 200-V commercial power supply. For example, Japanese Patent Application Laid-Open No. H07-199702 or U.S. Pat. No. 5,229,577 proposes an image heating apparatus having a first current path and a second current path extending in a longitudinal direction of the heater and a method of switching the heater resistance value by connecting the two current paths in series or in parallel. In order to switch the two current paths between a serial connection and a parallel connection, Japanese Patent Application Laid-Open No. H07-199702 describes a method of using a make contact (normally open contact) relay or a break contact (normally closed contact) relay and a BBM contact (break-before-make contact) relay. Note that instead of the BBM contact relay, two make contact relays or a make contact relay and a break contact relay may be used. U.S. Pat. No. 5,229,577 describes a method of switching using the two BBM contact relays.

Unfortunately, the image heating apparatus using the heater resistance value switching method described in Japanese Patent Application Laid-Open No. H07-199702 or U.S. Pat. No. 5,229,577 causes an increase in noise level of a noise terminal voltage due to power control (phase control) of the heater in a state in which the two current paths of the heater are connected in series.

SUMMARY OF THE INVENTION

In view of such circumstances, the present invention has been made, and an object of the present invention is to provide an image heating apparatus using a heater resistance value switching method of suppressing an increase in noise level of a noise terminal voltage due to heater power control.

Another object of the present invention is to provide an image heating apparatus including a first heat generation member and a second heat generation member heating by power supplied from a commercial power supply through a power supply path, a connection state switching section switching the first heat generation member and the second heat generation member between a serial connection state and a parallel connection state, the connection state switching section having a first relay having a make contact or a break contact and a second relay having a transfer contact, a drive element provided in the power supply path and used for controlling power supplied to the first heat generation member and the second heat generation member, and a capacitor connected between a power supply path extending from the first relay to the first and the second heat generation members and a power supply path extending from the drive element to the commercial power supply.

Further objects of the present invention will be apparent from the following detailed description and the accompanying drawings.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Now, embodiments for carrying out the present invention will be described in detail.

First Embodiment

Outline of Fixing Device

Figure 1A:
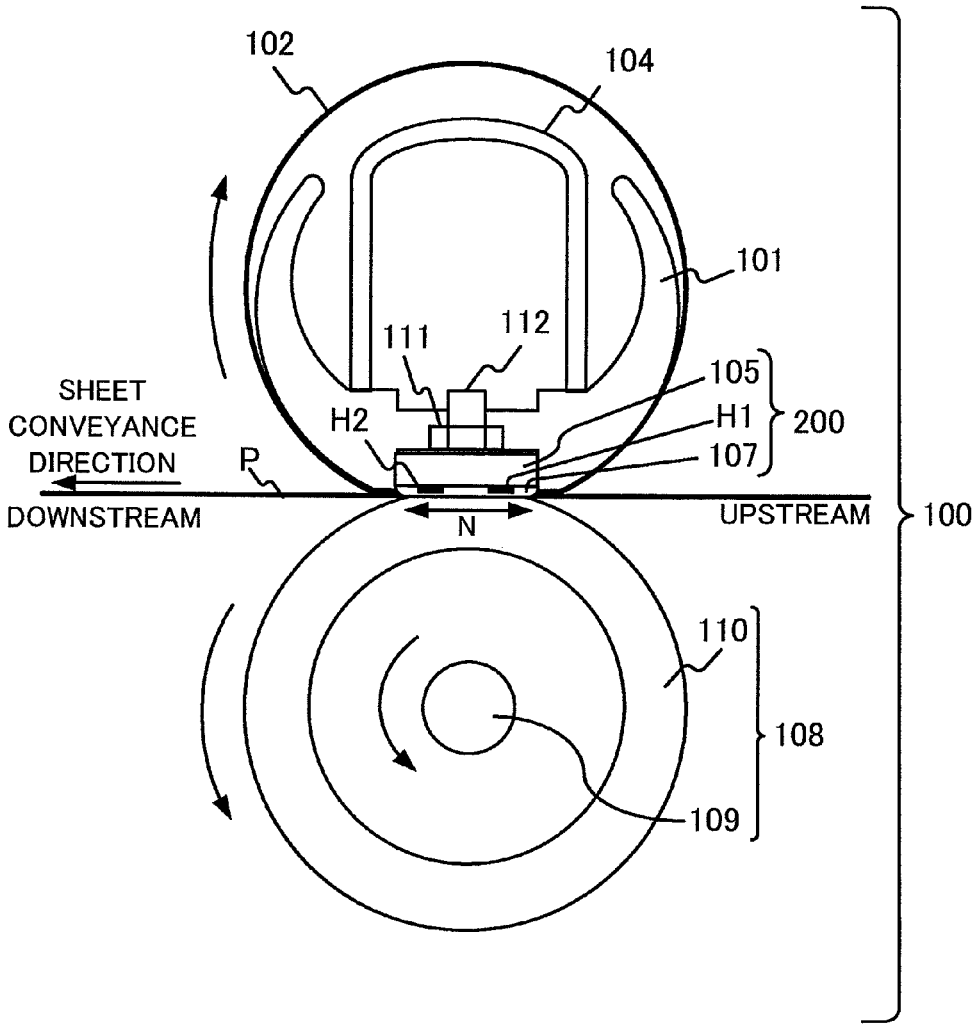
FIG. 1A illustrates a cross section of a fixing apparatus according to a first embodiment.
Figure 13:
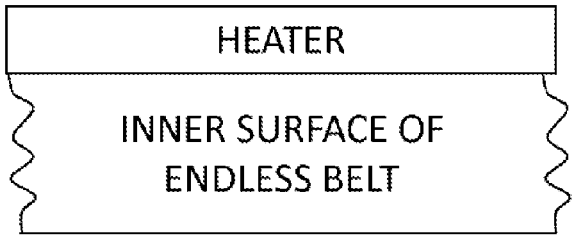
FIG. 13 is a schematic block diagram showing a heater contacting a portion of an inner surface of an endless belt.

FIG. 1A illustrates a cross section of a fixing apparatus 100 as an example of an image heating apparatus of a first embodiment. The fixing apparatus 100 includes: a cylindrical film (endless belt) 102; a heater 200 contacting an inner surface of the film 102, as shown in FIG. 13; and a pressure roller (nip portion forming member) 108 forming a fixing nip portion N together with the heater 200 sandwiching the film 102 therebetween. The pressure roller 108 includes a core bar 109 and an elastic layer 110. The pressure roller 108 is powered by an unillustrated motor and is rotated in a direction indicated by the arrows. The film 102 is rotated following the rotation of the pressure roller 108. The heater 200 is held by a holding member 101. The holding member 101 also functions as a guide for guiding the rotation of the film 102. A stay 104 is provided to apply pressure on the holding member 101 by an unillustrated spring.

Figure 14:
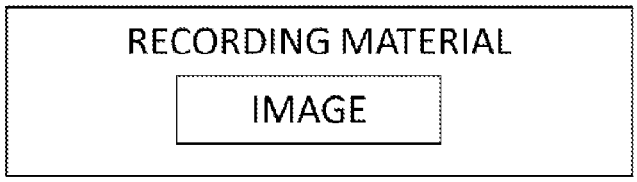
FIG. 14 is a schematic block diagram showing a recording material bearing an image.

The heater 200 (heating unit) includes: a ceramic heater substrate 105; a current path H1 and a current path H2 formed on the heater substrate 105 using a heat resistance member as a heat source; and an insulating surface protection layer 107 covering the current paths H1 and H2. A temperature detection element 111 using a thermistor or the like abuts against a sheet passing region which is located on a rear side of the heater substrate 105 and through which a recording material (an envelope DL in the present embodiment) whose length in a direction perpendicular to a conveying direction is a minimum size usable in the image forming apparatus can pass. According to a temperature detected by the temperature detection element 111, power supply from the commercial power supply to the heater 200 is controlled. The recording material P bearing an unfixed toner image, as shown in FIG. 14, is conveyed from upstream to downstream in direction of conveying the recording material and is heated and fixed while being pinched and conveyed through the fixing nip portion N. Then, the unfixed toner image is subjected to a fixing process. A safety element 112 such as a thermo switch which is activated when the temperature of the heater 200 rises abnormally and then turns off a power supply line to the heater 200 also abuts against the rear side of the heater substrate 105. The safety element 112 abuts against the sheet passing region for passing the recording material with a minimum size in the same manner as the temperature detection element 111.

[Outline of Heater]

Figure 1B:
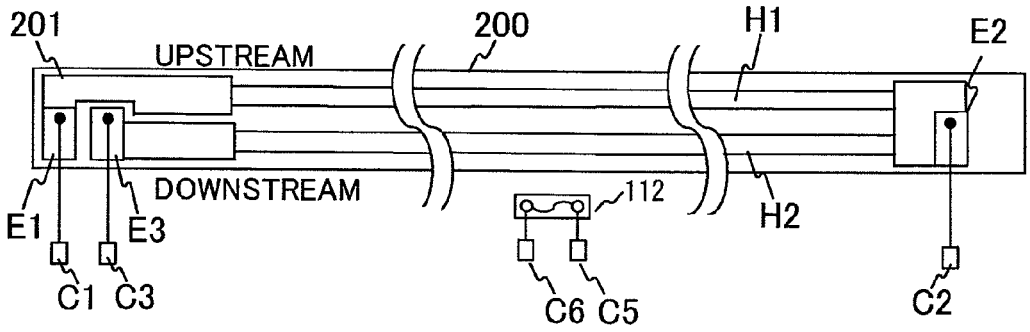
FIG. 1B illustrates a configuration of a heater of the first embodiment.

FIG. 1B illustrates a configuration of the heater 200 of the present embodiment. FIG. 1B illustrates heating patterns, conductive patterns, electrodes formed on a heater substrate 105 and connectors for connecting to a control circuit 210 illustrated in FIG. 2. The heater 200 has a current path H1 which is a first heat generation member made of a resistance heating pattern and a current path H2 which is a second heat generation member. The heater 200 uses a conductive pattern 201 made of a conductive material with a low resistance value so as to connect the electrodes and the current paths. One end of the current path H1 of the heater 200 is connected to an electrode E1 and the other end thereof is connected to an electrode E2. Power is supplied to the current path H1 from the control circuit 210 through the electrodes E1 and E2. One end of the current path H2 of the heater 200 is connected to an electrode E2 and the other end thereof is connected to an electrode E3. Power is supplied to the current path H2 from the control circuit 210 through the electrodes E2 and E3. The electrode E1 is connected to the connector C1, the electrode E2 is connected to the connector C2, and the electrode E3 is connected to the connector C3.

[Outline of Heater Control Circuit]

Figure 2:
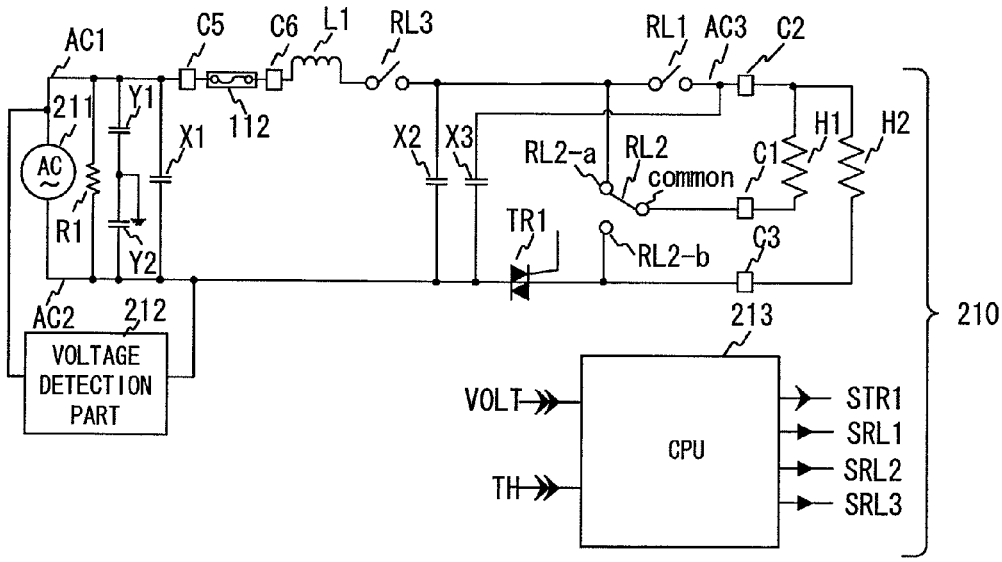
FIG. 2 is a circuit diagram of a heater control circuit of the first embodiment.
Figure 12:
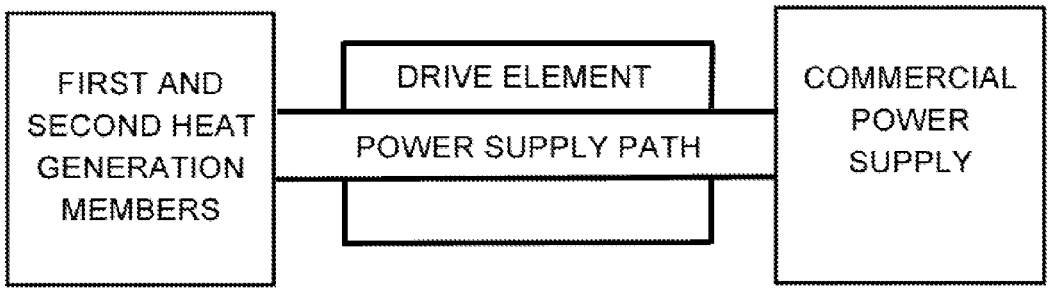
FIG. 12 is a schematic block diagram showing first and second heat generation members connected to a commercial power supply through a power supply path.

FIG. 2 is a circuit diagram of the control circuit 210 of the heater 200 of the present embodiment. Power control from a commercial power supply 211 to the heater 200 is performed by turning on and off a triac TR1 (drive element). The wires shown in FIG. 2 that connect the power supply 211 to the current paths H1 and H2 of heater 200 inherently comprise a power supply path therebetween, which is provided with the drive element or triac TR1, this arrangement being schematically shown in FIG. 12. The triac TR1 operates in response to an STR1 signal from the CPU 213 for controlling driving of the heater. The temperature of the heater 200 detected by the temperature detection element 111 is detected as a voltage divided by an illustrated pull-up resistor and input to the CPU 213 as a TH signal. Based on the temperature detected by the temperature detection element 111 and the temperature set by the heater 200, the CPU 213 calculates power to be supplied to the heater 200, for example, by a PI control (ratio integral control) and converts the calculated value to a control level of a phase angle (phase control) and a wave-number (wave-number control) to control the triac TR1. The heater 200 illustrated in FIG. 1B is connected to the control circuit 210 through the connectors C1, C2, and C3. The safety element 112 is also connected to the control circuit 210 through the connectors C5 and C6. When the temperature rises abnormally, the safety element 112 stops supplying power to the heater 200.

Now, the voltage detection part 212 and the relay control will be described. In FIG. 2, a relay RL1 (a first switch unit (a first relay)) and a RL3 (a third switch unit) are a make contact relay or a break contact relay; and a relay RL2 (a second switch unit (a second relay)) is an BBM contact (break-before-make contact (transfer contact)) relay. In addition, the FIG. 2 illustrates a connection state (off state) of each relay contact at a power-off time. More specifically, in the relay RL2, the off state is when the common contact is connected to the RL2-*a* contact, and the on state is when the common contact is connected to the RL2-*b* contact. The voltage detection part 212 determines whether the input voltage range of the commercial power supply 211 is, for example, a 100-V system from 100 V to 127 V (a second voltage) or a 200-V system from 200 V to 240 V (a first voltage) and outputs the voltage detection result to the CPU 213 as a VOLT signal. When the voltage range of the commercial power supply 211 is determined as a 200-V system, the VOLT signal is in a low level. When the voltage detection part 212 determines that the voltage of the commercial power supply 211 is a 200-V system, the CPU 213 maintains the relay RL1 and RL2 in an off state in response to the SRL1 signal and the SRL2 signal respectively. When the CPU 213 places the relay RL3 in an on state in response to the SRL3 signal, the heater 200 is in a power suppliable state from the commercial power supply 211. Since the relays RL1 and RL2 are in an off state, the current path H1 is serially connected to the current path H2, causing the heater 200 to be in a high resistance value state. In contrast to this, when the voltage detection part 212 detects that the voltage of the commercial power supply 211 is a 100-V system, the CPU 213 places the relays RL1 and RL2 in an on state in response to the SRL1 signal and the SRL2 signal respectively. When the CPU 213 places the relay RL3 in an on state in response to the SRL3 signal, the heater 200 is in a power suppliable state from the commercial power supply 211. Since the relays RL1 and RL2 are in an on state, the current path H1 is parallel connected to the current path H2, causing the heater 200 to be in a low resistance value state. The relay RL1 and the relay RL2 constitute a connection state switching section which switches the first heat generation member H1 and the second heat generation member H2 between the serial connection state and the parallel connection state.

[Noise Filter Configuration of Heater Control Circuit]

Now, the noise filter configuration reducing noise occurring due to power control (phase control) of the heater 200 will be described. In FIG. 2, capacitors Y1 and Y2 are interposed between the ground and the power terminals AC1 and AC2 of the commercial power supply 211. The capacitors Y1 and Y2 are collectively called Y capacitors. The capacitors X1 and X2 are interposed between the ground and the power terminals AC1 and AC2 of the commercial power supply 211. The capacitors X1 and X2 are collectively called X capacitors. The capacitors X1 and X2 together with an inductor L1 form a π-type filter. In FIG. 2, a capacitor X3 is disposed to reduce noise of a noise terminal voltage occurring due to phase control of the triac TR1. The capacitor X3 is to be connected between a power supply path extending from the first relay to the first and the second heat generation members and a power supply path extending from the drive element to the commercial power supply. That is, for example, as shown in FIG. 2, it can suppress noise occurring due to power control of the heater 200 from increasing the noise level of the noise terminal voltage in a case where the current paths H1 and H2 are serially connected to each other in the heater 200 by positioning the capacitor X3 between the power terminals AC2 and AC3.

[Outline of Voltage Detection Part]

Figure 3:
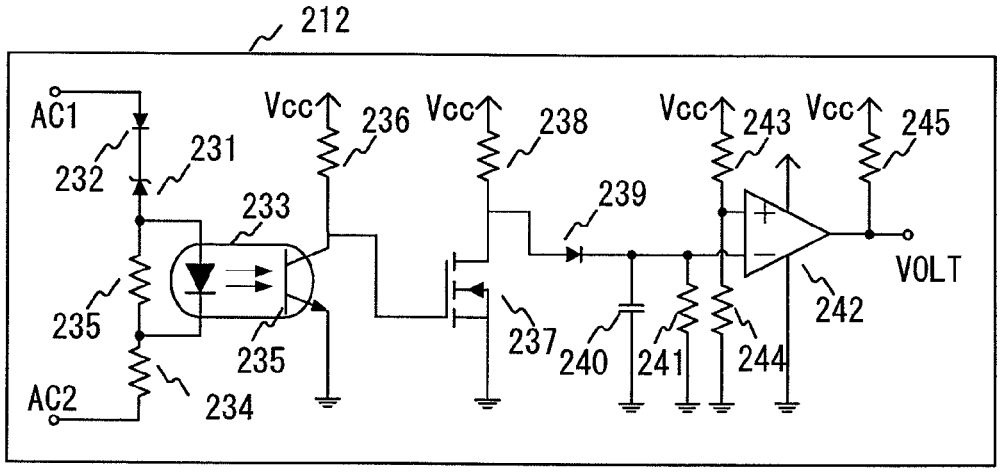
FIG. 3 is a circuit diagram of a voltage detection part of the first embodiment.

FIG. 3 is a circuit diagram of the voltage detection part 212 for detecting the voltage of the commercial power supply 211. The voltage detection part 212 determines whether the voltage applied between the power terminal AC1 (a first power terminal) and AC2 (a second power terminal) is a 100-V system or a 200-V system. In FIG. 3, a zener voltage of a zener diode 231 is selected such that a current flows when the commercial power supply 211 is a 200-V system. When the commercial power supply 211 is a 200-V system, the voltage applied between the power terminals AC1 and AC2 is higher than the zener voltage of the zener diode 231 and a current flows between the power terminals AC1 and AC2. FIG. 3 illustrates a current backflow prevention diode 232, a current-limiting resistor 234, and a protection resistor 235 for a photo coupler 233. When a current flows in a light-emitting diode of the photo coupler 233, a photo transistor 235 is turned on, a current flows from the power supply Vcc through a resistor 236, which places the gate voltage of an FET 237 in a low level. As a result, the FET 237 is in an off state and a charging current flows into a capacitor 240 from the power supply Vcc through a resistor 238. FIG. 3 further illustrates a current backflow prevention diode 239 and a discharging resistor 241. The higher the ratio of the time when the voltage applied between power terminals AC1 and AC2 is higher than the zener voltage of the zener diode 231, the higher the ratio of the off time of the FET 237. The higher the ratio of the off time of the FET 237, the longer the time when a charging current flows into the capacitor 240, and thus the higher the charging voltage value of the capacitor 240. As a result, when the voltage of the capacitor 240 exceeds a comparison voltage (a voltage obtained by dividing the voltage Vcc by the resistor 243 and the resistor 244) of the comparator 242, a current flows into an output portion of the comparator 242 from the power supply Vcc through a resistor 245, which places the VOLT signal in a low level.

[Noise Terminal Voltage Measuring Method]

Figure 4A:
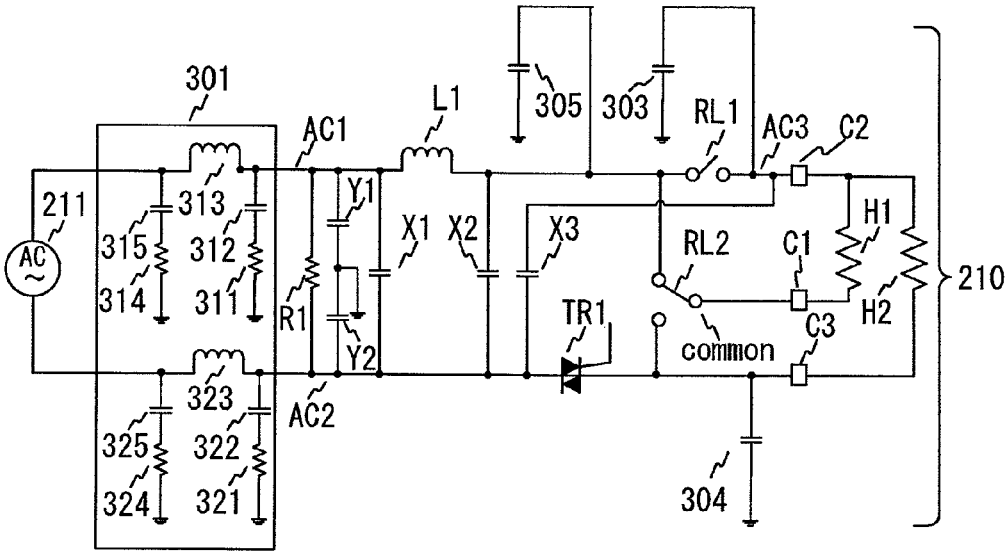
FIG. 4A illustrates the heater control circuit used for measuring a noise terminal voltage in the first embodiment.
Figure 4B:
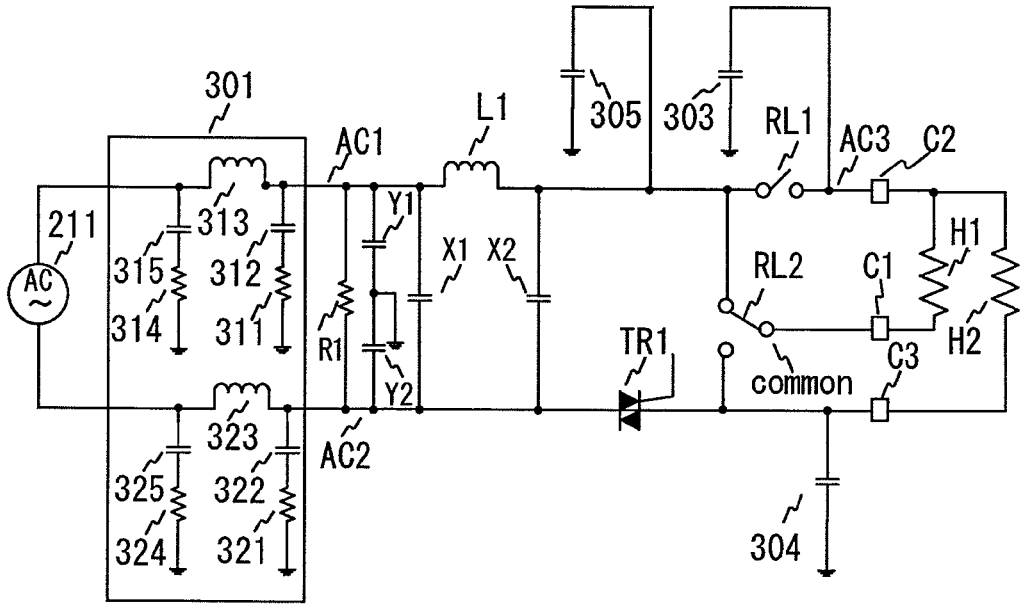
FIG. 4B illustrates the heater control circuit used for measuring a noise terminal voltage in the first embodiment.

FIG. 4A is a circuit diagram of the control circuit 210 for use in measuring noise terminal voltage simulation in order to describe an effect of suppressing noise terminal voltage noise by the capacitor X3. FIG. 4B is a circuit diagram of the control circuit 210 excluding the capacitor X3 from FIG. 4A to describe the effects of the capacitor X3 for the purpose of comparison. Since the capacitor X3 is excluded, the capacitance value of the capacitor X2 in FIG. 4B is set twice that of in FIG. 4A. Further, in FIGS. 4A and 4B, the relays RL1 and RL2 are set to connect the current paths H1 and H2 in series.

In FIG. 4A, a line impedance stabilization network 301 (hereinafter referred to as "LISN 301") refers to a circuit network for measuring a noise voltage induced on a power line as a voltage value of 50Ω. The noise level of a noise terminal voltage is greatly affected by the impedance on the commercial power supply side. For example, the larger the impedance of the commercial power supply 211, the less the noise level. Thus, in order to measure the noise terminal voltage, it is necessary to uniformly control the impedance viewed from the control circuit 210 as the equipment under test (EUT) toward the commercial power supply 211. In FIG. 4A, the LISN 301 is provided to control the impedance viewed from the control circuit 210 as the EUT by 50-μH-inductors 313 and 323, 5Ω-resistors 314 and 324, and resistors 311 and 321 as the 50Ω-measuring instrument input impedance. Note that in the LISN 301, capacitors 312, 315, 322, and 325 are provided to cut the DC components. Then, the noise terminal voltage induced on the power terminal AC1 is measured by the voltage applied to the resistor 311 of the LISN 301, and the noise terminal voltage induced on the power terminal AC2 is measured by the voltage applied to the resistor 321 of the LISN 301.

In addition, stray capacitors 303 to 305 are capacitance components illustrated to handle the capacitance components distributed on a substrate of the control circuit 210, cables connecting the substrate of the control circuit 210 and the heater 200, and a substrate of the heater 200 as a lumped constant circuit. A simulation is performed on the stray capacitors 303 to 305 using the respective capacitors of the same capacitance. The stray capacitors 303 to 305 cause common mode noise in response to switching of the triac TR1. In particular, the stray capacitors 303 and 304 cause the noise. The common mode noise caused by the stray capacitor 303 is a problem peculiar to the fixing device having a function of switching the resistors between the serial connection and the parallel connection. The switching of the triac TR1 causes normal mode noise due to circuit LC resonance and common mode noise due to charging and discharging of the stray capacitor. The common mode noise and the normal mode noise will be described later. The present embodiment provides the capacitor X3 to suppress surge noise occurring due to charging and discharging of the stray capacitor 303 in response to switching of the triac TR1. The effects of the capacitor X3 differ depending on the capacitances of the capacitors X1 to X3, the stray capacitors 303 to 305, and the capacitances of the capacitors Y1 and Y2, the inductance of the inductor L1, the parasitic capacitance, the resistance values of the current paths H1 and H2, the switching speed of the triac TR1, and the like. The circuit constant set to measure the noise terminal voltage is an example for describing the effects of the capacitor X3.

[Measurement Results of Noise Terminal Voltage]

FIGS. 5A to 6J in the present embodiment illustrate results of measuring noise terminal voltages using the circuits illustrated in FIGS. 4A and 4B respectively for describing the effects of the capacitor X3. FIGS. 5A to 5E illustrate the results of measuring noise terminal voltages of the control circuit 210 illustrated in FIG. 4A, and FIGS. 5F to 5J illustrate the results of measuring noise terminal voltages of the control circuit 210 illustrated in FIG. 4B for comparing the effects of the capacitor X3.

Figure 5A:
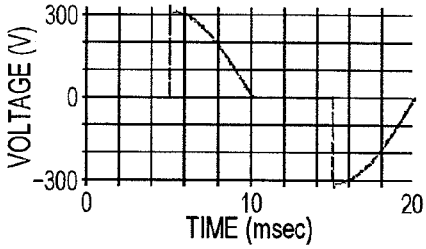
FIGS. 5A, 5B, 5C, 5D, 5E, 5F, 5G, 5H, 5I and 5J illustrate a measured waveform of a noise terminal voltage of the heater control circuit of the first embodiment.
Figure 5F:
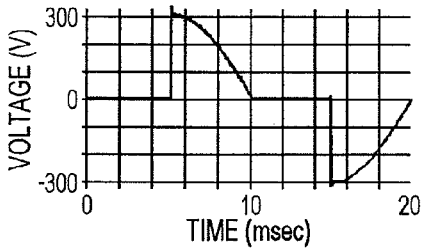

FIGS. 5A and 5F are a waveform diagram of the voltages applied to the respective heating patterns H1 and H2 of the heater 200 in a cycle (20 msec) of the commercial power supply 211. Each waveform diagram illustrates a waveform in a state of being phase-controlled to a duty cycle of 50% by the triac TR1. Hereinafter, noise occurring at a positive phase control timing (at 5 msec) will be described. Noise occurring at a negative phase control timing (at 15 msec) produces the same results as at the positive phase control timing, and thus the description is omitted. Note that the detail will be described later, but surge noise is caused by a current charged and discharged to and from the stray capacitors 304 and 303. More specifically, in a positive phase, a surge voltage due to discharging from the stray capacitors occurs, and in a negative phase, a surge voltage due to charging to the stray capacitors occurs. The surge phase is inverted 180° between charging and discharging.

Figure 5B:
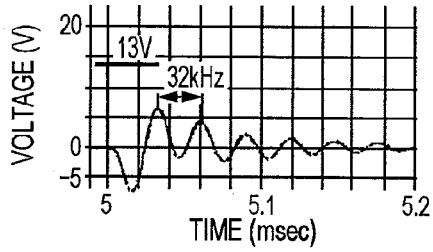
Figure 5C:
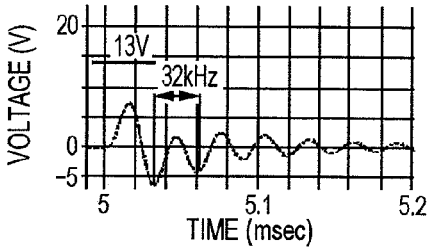
Figure 6A:
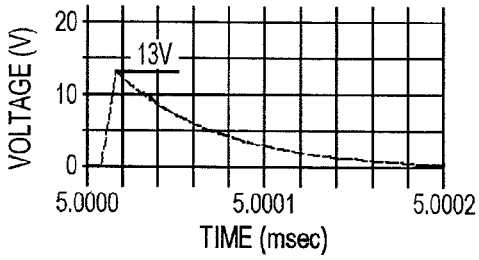
FIGS. 6A, 6B, 6C, 6D, 6E, 6F, 6G, 6H, 6I and 6J illustrate a measured waveform of a noise terminal voltage of the heater control circuit of the first embodiment.
Figure 6B:
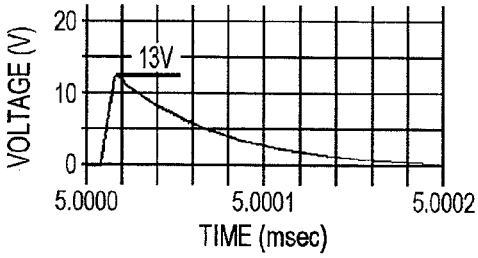

FIG. 5B illustrates a waveform of a voltage (noise component detected by noise terminal voltage measurement) applied to the resistor 311 of the LISN 301 in FIG. 4A at a timing (at 5 msec in FIG. 5A) when the triac TR1 is phase-controlled. It is understood from FIG. 5B, that a 13-V sudden surge noise voltage occurs at a timing when the triac TR1 is turned on, and then about 32-kHz resonance noise occurs. Note that FIG. 6A illustrates an enlarged waveform of surge noise at a peak voltage of 13 V illustrated in FIG. 5B. FIG. 5C illustrates a waveform of a voltage (noise component detected by noise terminal voltage measurement) applied to the resistor 321 of the LISN 301 in FIG. 4A at a timing (at 5 msec in FIG. 5A) when the triac TR1 is phase-controlled. It is understood from FIG. 5C, that a 13-V sudden surge noise voltage occurs at a timing when the triac TR1 is turned on, and then about 32-kHz LC resonance noise occurs. Note that FIG. 6B illustrates an enlarged waveform of surge noise at a peak voltage of 13 V illustrated in FIG. 5C. It is understood from FIGS. 5B and 5C that the noise component is a common mode noise component because the phase of the surge noise component of the voltage applied to the resistor 321 is substantially the same as that of the voltage applied to the resistor 311 and the same-phase noise occurs in both the power terminals AC1 and AC2. In contrast to this, it is understood that the noise component is a normal mode noise component because the phase of the about 32-kHz LC resonance noise component is inverted substantially 180° between the resistor 311 and the resistor 321 of the LISN 301.

Figure 5G:
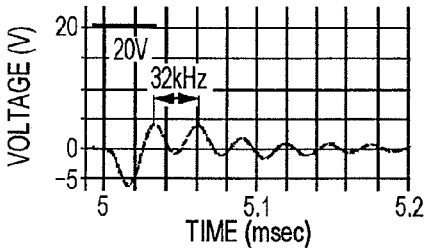
Figure 5H:
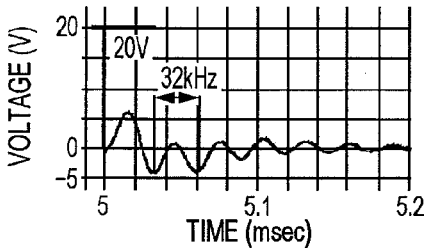

FIG. 5G illustrates a waveform of a voltage (noise component detected by noise terminal voltage measurement) applied to the resistor 311 of the LISN 301 in FIG. 4B at a timing (at 5 msec in FIG. 5F) when the triac TR1 is phase-controlled. It is understood from FIG. 5G, that a 20-V sudden surge noise voltage occurs at a timing when the triac TR1 is turned on, and then about 32-kHz resonance noise occurs. Note that FIG. 6F illustrates an enlarged waveform of surge noise at a peak voltage of 20 V illustrated in FIG. 5G. FIG. 5H illustrates a waveform of a voltage (noise component detected by noise terminal voltage measurement) applied to the resistor 321 of the LISN 301 in FIG. 4B at a timing (at 5 msec in FIG. 5F) when the triac TR1 is phase-controlled. It is understood from FIG. 5H, that a 20-V sudden surge noise voltage occurs at a timing when the triac TR1 is turned on, and then about 32-kHz resonance noise occurs. Note that FIG. 6G illustrates an enlarged waveform of surge noise at a peak voltage of 20 V illustrated in FIG. 5H. It is understood from FIGS. 5B, 5C, 5G, and 5H that in comparison with the simulated measurement results of the common mode surge noise components detected by measurement of the noise terminal voltages applied to the resistors 311 and 321 of the LISN 301 in FIGS. 4A and 4B, the surge noise component in FIG. 4B is larger than that in FIG. 4A.

Figure 5D:
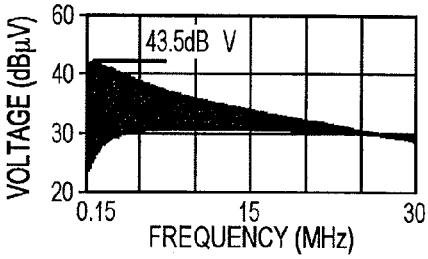

FIG. 5D illustrates the results that a voltage (noise component detected by noise terminal voltage measurement) applied to the resistor 311 of the LISN 301 in FIG. 4A is subjected to Fast Fourier Transform. The measurement of a noise terminal voltage often involves the measurement of a frequency band of 150 kHz to 30 MHz. Thus, the Fast Fourier Transform diagrams in FIGS. 5A to 5J and FIGS. 11A to 11J described later illustrate the component of the frequency band of 150 kHz to 30 MHz. It is understood from FIG. 5D that the noise component at a low frequency region near 150 kHz is the largest, namely, about 43.5 dBμV. FIG. 5E illustrates the results that a voltage (noise component detected by noise terminal voltage measurement) applied to the resistor 321 of the LISN 301 in FIG. 4A is subjected to Fast Fourier Transform. It is understood from FIG. 5E that the noise component at a low frequency region near 150 kHz is the largest, namely, about 43.5 dBμV.

Figure 5I:
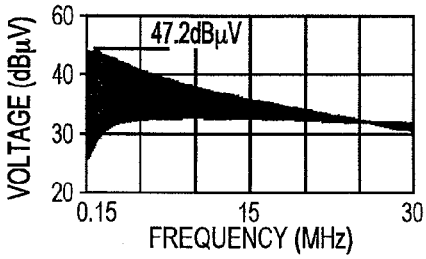
Figure 5E:
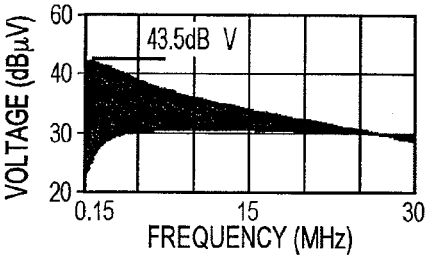
Figure 5J:
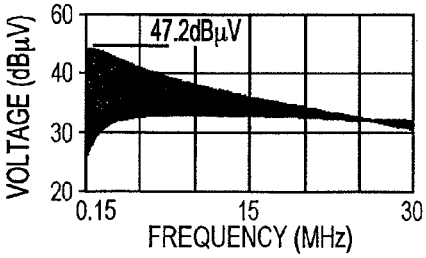

FIG. 5I illustrates the results that a voltage (noise component detected by noise terminal voltage measurement) applied to the resistor 311 of the LISN 301 in FIG. 4B is subjected to Fast Fourier Transform. It is understood from FIG. 5I that the noise component at a low frequency region near 150 kHz is the largest, namely, about 47.2 dBμV. FIG. 5J illustrates the results that a voltage (noise component detected by noise terminal voltage measurement) applied to the resistor 321 of the LISN 301 in FIG. 4B is subjected to Fast Fourier Transform. It is understood from FIG. 5J that the noise component at a low frequency region near 150 kHz is the largest, namely, about 47.2 dBμV.

It is understood from the comparison of the measurement results of the noise terminal voltage using the circuits illustrated in FIGS. 4A and 4B that in FIG. 4A, the peak voltage of surge noise is suppressed to 13 V which is lower than the peak voltage 20 V in FIG. 4B. Sharp surge noise with a short pulse width contains high frequency component noise. The higher the peak voltage of the surge noise, the higher the noise component of 150 kHz to 30 MHz. The about 32-kHz LC resonance noise occurring in FIG. 4A has a frequency lower than a lower cutoff frequency (150 kHz) for measuring the noise terminal voltage, and thus less affects the noise measurement of the noise terminal voltage.

As described hereinbefore, the capacitor X3 disposed in the control circuit 210 can suppress the peak voltage of surge noise occurring when the triac TR1 is turned on and can reduce the noise component of 150 kHz to 30 MHz.

[Noise Reduction by Capacitor X3]

The surge noise generation mechanism described in FIGS. 5A to 5J and the noise reduction effect by the capacitor X3 used in the control circuit 210 of the present embodiment will be described. FIGS. 6A and B are an enlarged surge noise waveform of a peak voltage of 13 V illustrated in FIGS. 5B and 5C with a reduced time width. FIGS. 6F and 6G are an enlarged surge noise waveform of a peak voltage of 20 V illustrated in FIGS. 5G and 5H with a reduced time width. Hereinafter, in comparison with FIG. 4A having the capacitor X3 and FIG. 4B not having the capacitor X3, the reason why the control circuit 210 having the capacitor X3 can reduce the aforementioned surge noise waveform will be described.

Figure 6C:
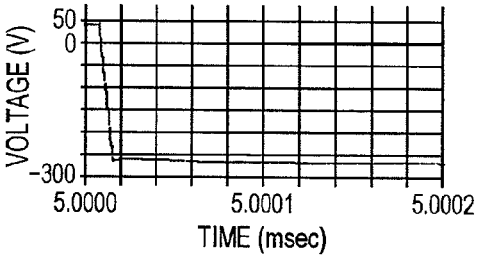

FIG. 6C is a waveform diagram of the voltage charged to the stray capacitor 304 in FIG. 4A. FIG. 6H is a waveform diagram of the voltage charged to the stray capacitor 304 in FIG. 4B. It is understood from these voltage waveforms that a sudden voltage drop occurs at a timing (at 5 msec) when the triac TR1 is turned on, which indicates that the charge charged to the stray capacitor 304 is discharged. When the triac TR1 is in an on state, the charge charged to the stray capacitor 304 flows into the resistor 321 of the LISN 301 through the triac TR1, which generates positive surge noise. The positive surge noise generated by discharging from the stray capacitor 304 also causes a similar voltage fluctuation to be generated in the power terminal AC1 through the capacitor X1. Thus, similar surge noise occurs in the resistor 311 of the LISN 301.

Figure 6D:
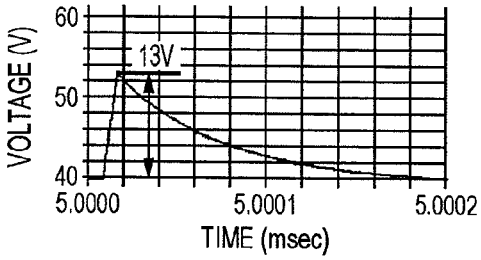

FIG. 6D is a waveform diagram of the voltage charged to a capacitance component of the stray capacitor 305 in FIG. 4A. FIG. 6I is a waveform diagram of the voltage charged to a capacitance component of the stray capacitor 305 in FIG. 4B. Even if the triac TR1 is in an on state, the potential of the power terminal AC1 does not change. Thus, surge noise due to a current discharged from the stray capacitor 305 does not occur. However, the positive surge noise generated by discharging from the stray capacitor 304 and the stray capacitor 303 described later causes similar surge noise to be generated in the voltage waveform of the stray capacitor 305 through the capacitor X2.

Figure 6E:
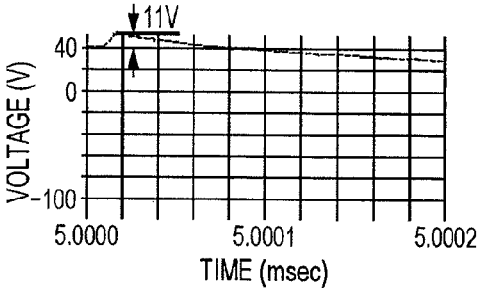
Figure 6F:
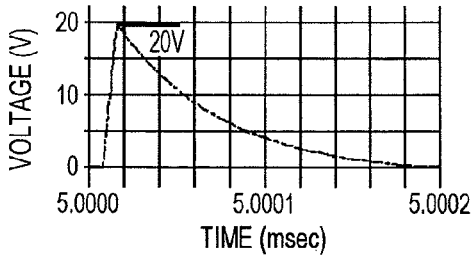
Figure 6G:
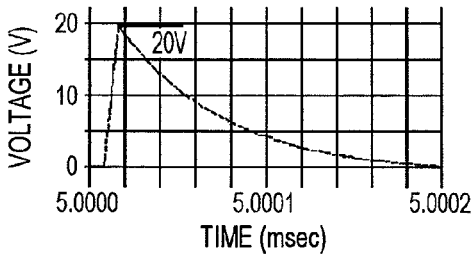
Figure 6H:
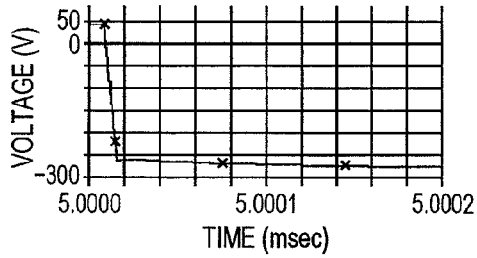
Figure 6I:
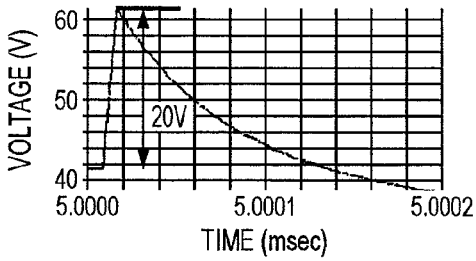
Figure 6J:
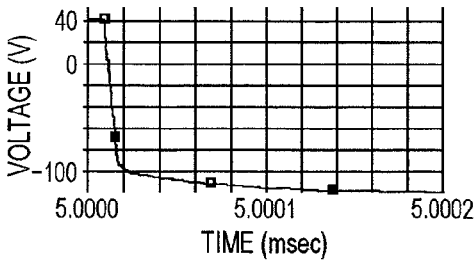

FIG. 6E is a waveform diagram of the voltage charged to a capacitance component of the stray capacitor 303 in FIG. 4A. FIG. 6J is a waveform diagram of the voltage charged to a capacitance component of the stray capacitor 303 in FIG. 4B. It is understood from the waveform in FIG. 6J that a sudden voltage drop occurs at a timing when the triac TR1 is turned on, which indicates that the charge charged to the stray capacitor 303 is discharged. When the triac TR1 is in an on state, the charge charged to the stray capacitor 303 flows into the resistor 321 of the LISN 301 through the current path H2, which generates positive surge noise. In other word, like the aforementioned stray capacitor 304, discharging of the charge charged to the stray capacitor 303 also causes positive surge noise. Meanwhile, it is understood from the voltage waveform illustrated in FIG. 6E that the capacitor X3 has a sufficiently large capacitance component with respect to the stray capacitor 303 and thus functions to hold the voltage between the power terminal AC2 and the power terminal AC3. Accordingly, it is understood from the voltage waveform in FIG. 6E that a sudden voltage drop does not occur at a timing when the triac TR1 is turned on, which indicates that the charge charged to the stray capacitor 303 is not suddenly discharged. The stray capacitor 303 is discharged based on a long time constant and the discharge cycle is a frequency lower than 150 kHz, which can reduce the influence to the noise terminal voltage.

In a fixing device not switching the heater resistors between the serial connection and the parallel connection, a middle point or a connection point between the current paths H1 and H2 is not connected to the control circuit 210, and thus the stray capacitor 303 can be almost ignored. However, like the present embodiment, in a case in which the fixing device capable of switching the heater resistors between the serial connection and the parallel connection is used by placing the relay RL1 in an off state to serially connect the heater resistors, surge noise caused by the stray capacitor 303 causes an increase in noise terminal voltage. On the contrary, when the heater resistors are connected in parallel and the relay RL1 is in an on state with a low resistance value, which means a state in which the stray capacitor 303 and the stray capacitor 305 are connected in parallel, and thus surge noise does not cause an increase in noise terminal voltage.

[Relay Control Sequence]

Figure 7A:
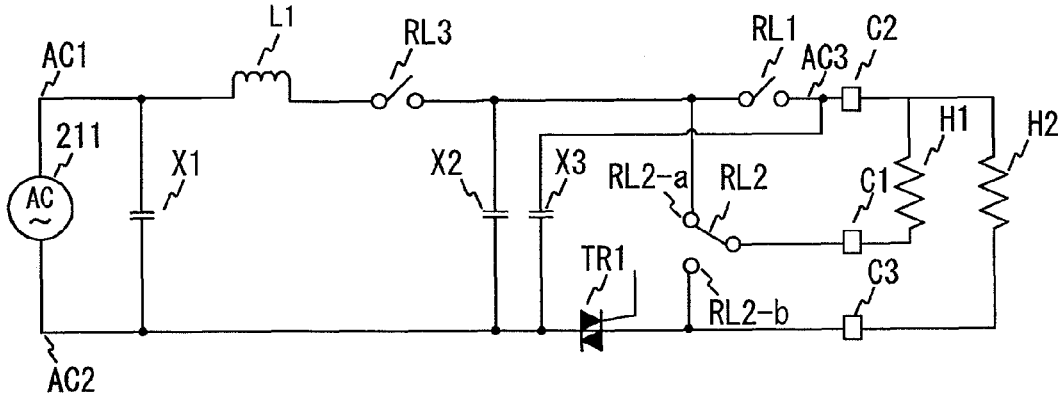
FIGS. 7A, 7B and 7C illustrate relay control sequence circuits of the first embodiment.
Figure 7B:
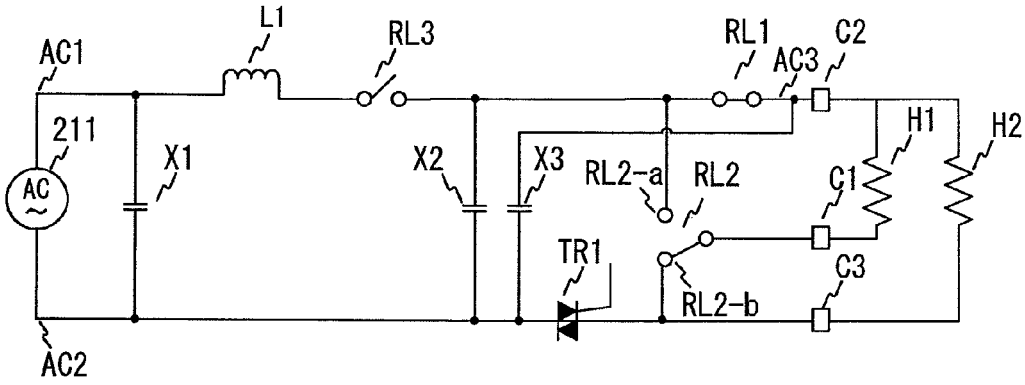
Figure 7C:
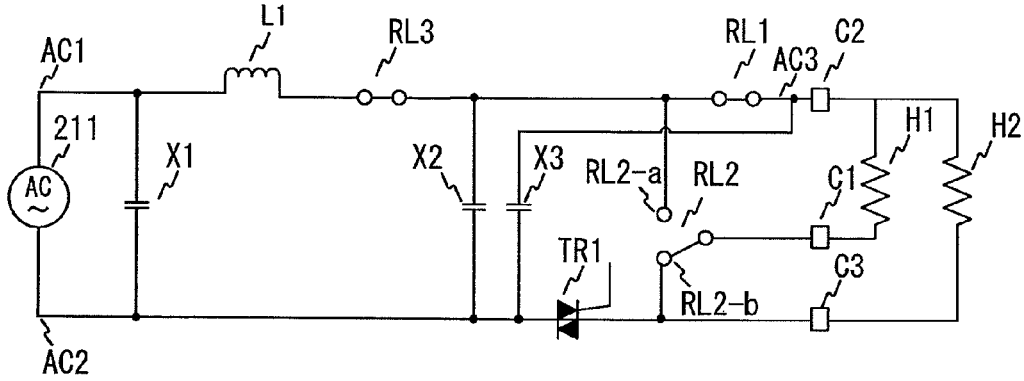

By referring to FIGS. 7A to 7C, the following description will focus on the method of activating the control circuit 210 in a state capable of supplying power to the heater 200 so as to prevent a rush current flowing into the capacitors X2 and X3 from damaging the contact points of the relays RL3 and RL1. FIG. 7A illustrates a connection state of the relays RL1, RL2, and RL3 at a power-off time in the control circuit 210. In FIG. 7A, the relays RL1 and RL2 are in an off state, and the current paths H1 and H2 of the heater 200 are in a serial connection state. In FIG. 7B, the relays RL1 and RL2 are in an on state, and the current paths H1 and H2 of the heater 200 are in a parallel connection state. Note that when the CPU 213 changes the state of the relays RL1 and RL2 to an on state, the relay RL3 is maintained in the off state, and thus no rush current occurs in the capacitor X3. In FIG. 7C, the relay RL3 is placed in an on state from the state in FIG. 7B. More specifically, FIG. 7C illustrates a state capable of supplying power from the commercial power supply 211 to the heater 200. A rush current flowing from the commercial power supply 211 and the capacitor X1 to the capacitors X2 and X3 causes damage to an electrical contact points of the relays RL3 and RL1, but the rush current can be suppressed by the inductor L1. In the configuration of the control circuit 210 in the state of FIG. 7C, at a timing when the triac TR1 is turned on, a current discharged from the capacitor X3 flows into the triac TR1 through the current path H2, which can prevent an excessive momentary current from flowing into the triac TR1. In order to prevent a current charged and discharged to and from the capacitor X3 from damaging the triac TR1, the control circuit 210 is configured such that the AC1 of the commercial power supply is connected to the relay RL1, and the AC2 of the commercial power supply is connected to the triac TR1.

Figure 8:
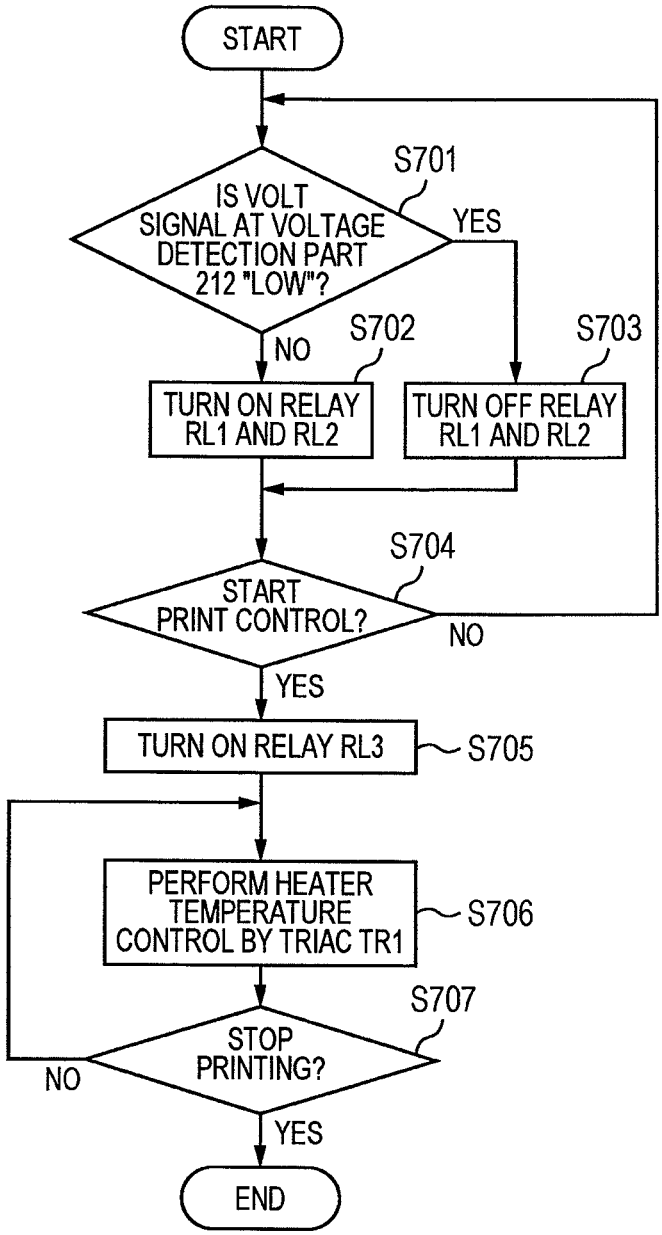
FIG. 8 is a flowchart of a relay control sequence procedure of the first embodiment.

FIG. 8 is a flowchart illustrating a relay control sequence procedure of the present embodiment. The procedure is executed by the CPU 213 based on the programs stored in an unillustrated ROM. Note that when the sequence procedure of FIG. 8 starts, the control circuit 210 is in a standby state and the relays RL1 to RL3 are in an off state.

Based on the VOLT signal output from the voltage detection part 212, the CPU 213 determines the power supply voltage range of the commercial power supply 211 in step 701 (hereinafter referred to as "S701"). When the CPU 213 determines that the VOLT signal of the voltage detection part 202 is not low, namely, the power supply voltage is a 100-V system (for example, 100 V to 127 V), the process moves to S702 (S701). On the contrary, when the CPU 213 determines that the VOLT signal of the voltage detection part 202 is low, namely, the power supply voltage is a 200-V system (for example, 200 V to 240 V), the process moves to S703 (S701). In S702, the power supply voltage is a 100-V system, and thus the CPU 213 places the relays RL1 and RL2 in an on state based on the SRL1 signal and the SRL2 signal. Then, the process moves to S704. In S703, the power supply voltage is a 200-V system, and thus the CPU 213 places the relays RL1 and RL2 in an off state based on the SRL1 signal and the SRL2 signal. Then, the process moves to S704. In S704, the CPU 213 determines whether or not print control starts. If not, the processes from S701 to S703 are repeated until the CPU 213 determines that the print control starts. When the print control starts, the CPU 213 places the relay RL3 in an on state based on the SRL3 signal to indicate the state capable of supplying power to the heater 200 (S705). In S706, based on the TH signal indicating a detected temperature of the heater 200 output from the temperature detection element 111, the CPU 213 uses a PI control to control the triac TR1 and control power to be supplied to the heater 200 (phase control or wavenumber control). The CPU 213 determines whether or not print ends. If not, the process S706 is repeated until the CPU 213 determines that the print ends, upon which the CPU 213 ends the control.

The effects of the capacitor X3 described in the present embodiment are not limited to the noise filter configuration (the capacitors X1 and X2, the inductor L1, and the capacitors Y1 and Y2) of the control circuit 210. For example, in the π-type filter configuration in which the inductor L1 is interposed between the power terminal AC2 and the triac TR1, the aforementioned high frequency surge noise causes the similar noise to be generated in the LISN 301 through the capacitor X2, and thus substantially the same measurement results are obtained.

As described hereinbefore, the present embodiment can provide an image heating apparatus having the capacitor X3 in the control circuit 210 and capable of switching the resistors to suppress an increase in noise level of the noise terminal voltage by performing power control on the heater 200. The present embodiment uses the capacitor X3 to suppress noise. The X capacitors for use in between the commercial power supply lines are often smaller and less expensive than the aforementioned inductors. Further, the capacitor X3 of the present proposal may be used together with the inductor and a common mode choke coil.

Second Embodiment

The second embodiment differs from the first embodiment in that in the first embodiment, the relay RL1 uses a make contact relay or a break contact relay, while in the second embodiment, the relay RL1 uses a BBM contact relay. Note that in the present embodiment, the description of the same configuration as that of the first embodiment will be omitted.

[Outline of Heater and Heater Control Circuit]

Figure 9A:
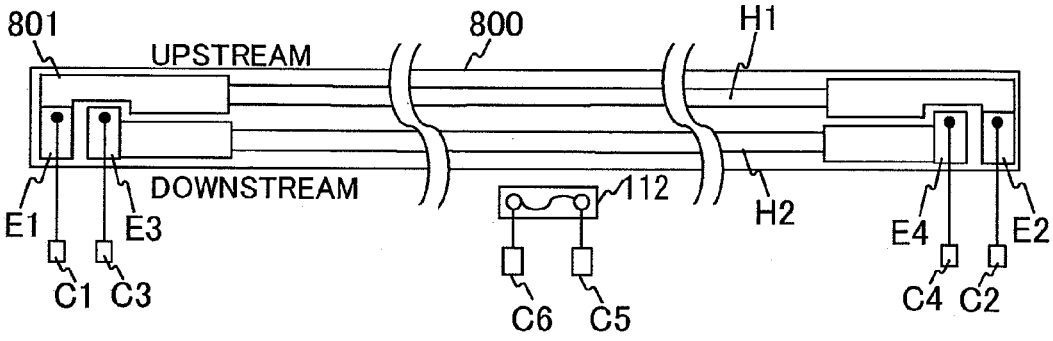
FIG. 9A illustrates a configuration of a heater of a second embodiment.
Figure 9B:
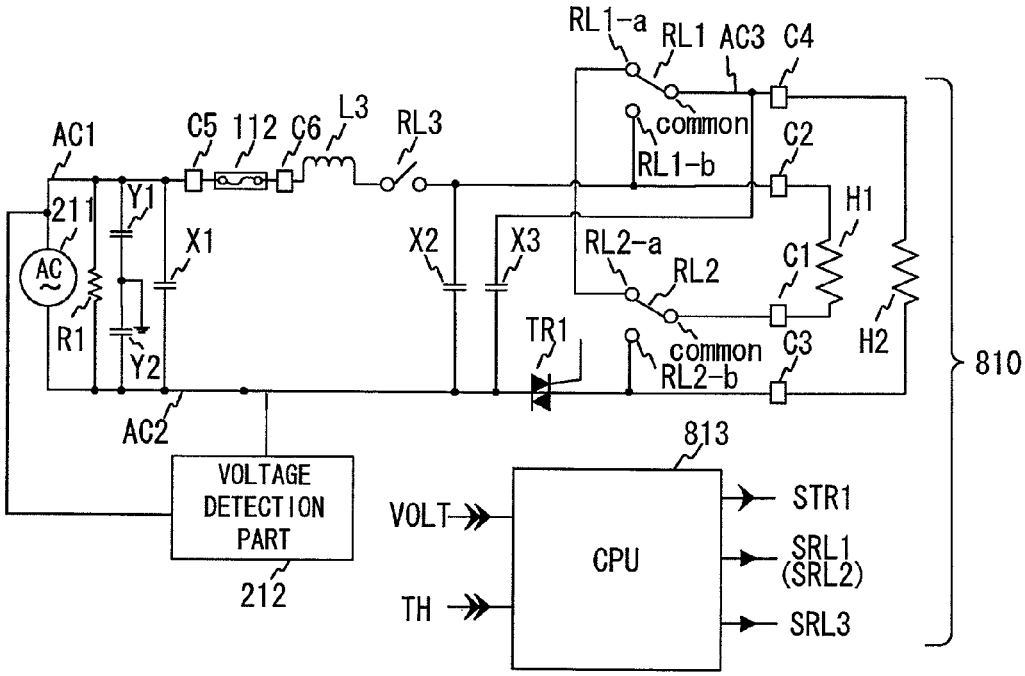
FIG. 9B is a circuit diagram of the heater control circuit.

FIG. 9A is a configuration diagram of a heater 800 for use in the present embodiment. FIG. 9B is a circuit diagram of a control circuit 810 for the heater 800. FIG. 9A illustrates heating patterns, conductive patterns, and electrodes formed on a substrate of the heater 800. The heater 800 has current paths H1 and H2 each made of a resistance heating pattern. The heater 800 uses a conductive pattern 801 made of a conductive material with a low resistance value in order to connect an electrode and a current path. Power is supplied to the first current path H1 of the heater 800 through the electrodes E1 and E2. Power is supplied to the second current path H2 through the electrodes E3 and E4. The electrode E1 is connected to the connector C1, the electrode E2 is connected to the connector C2, the electrode E3 is connected to the connector C3, and the electrode E4 is connected to the connector C4.

FIG. 9B illustrates the control circuit 810 of the heater 800 of the present embodiment. FIG. 9B illustrates the connection state of the relays RL1, RL2, and RL3 in a power off state. The relays RL1 and RL2 uses a BBM contact relay, and the relay RL3 uses a make contact relay or a break contact relay. In FIG. 9B, in the relay RL1, the common contact is connected to the RL1-*a* contact, and the common contact is not connected to the RL1-*b* contact. Likewise, in the relay RL2, the common contact is connected to the RL2-*a* contact, and the common contact is not connected to the RL2-*b* contact. When the voltage detection part 212 detects that the voltage range of the commercial power supply 211 is a 200-V system, the CPU 813 places the relay RL1 and the RL2 in an off state in response to the SRL1 signal (or the SRL2 signal). The present embodiment is characterized in that the relay RL2 operates in response to the relay RL1. When the SRL1 signal of the CPU 813 becomes low, the relay RL2 and the relay RL1 enters an off state. In response to the SRL3 signal, the CPU 813 places the relay RL3 in an on state to indicate the state capable of supplying the commercial power supply 211 to the heater 800. Since the relays RL1 and RL2 are in an off state, the first current path H1 is serially connected to the second current path H2, causing the heater 800 to be in a high resistance value state. In contrast to this, when the voltage detection part 212 detects that the voltage of the commercial power supply 211 is a 100-V system, the CPU 813 places the signal SRL1 in high level to place the relays RL1 and RL2 in an on state. When the CPU 813 places the relay RL3 in an on state in response to the SRL3 signal, the heater 800 is in a power suppliable state from the commercial power supply 211. Since the relays RL1 and RL2 are in an on state, the first current path H1 is parallel connected to the second current path H2, causing the heater 800 to be in a low resistance value state.

As described hereinbefore, the present embodiment uses a BBM contact relay as the relay RL1, but interposes the capacitor X3 between the power terminals AC2 and AC3, and thereby can suppress an increase in noise level of the noise terminal voltage due to surge noise of the heater power control.

Third Embodiment

The third embodiment differs in circuit configuration from the first embodiment in that the control circuit 810 in the third embodiment adds an inductor L2 to the noise filter configuration (capacitors X1 and X2, inductor L1, capacitors Y1 and Y2) of the control circuit 210 of the first embodiment. Note that in the present embodiment, the description of the same configuration as that of the first embodiment will be omitted.

[Measurement Circuit of Noise Terminal Voltage]

Figure 10A:
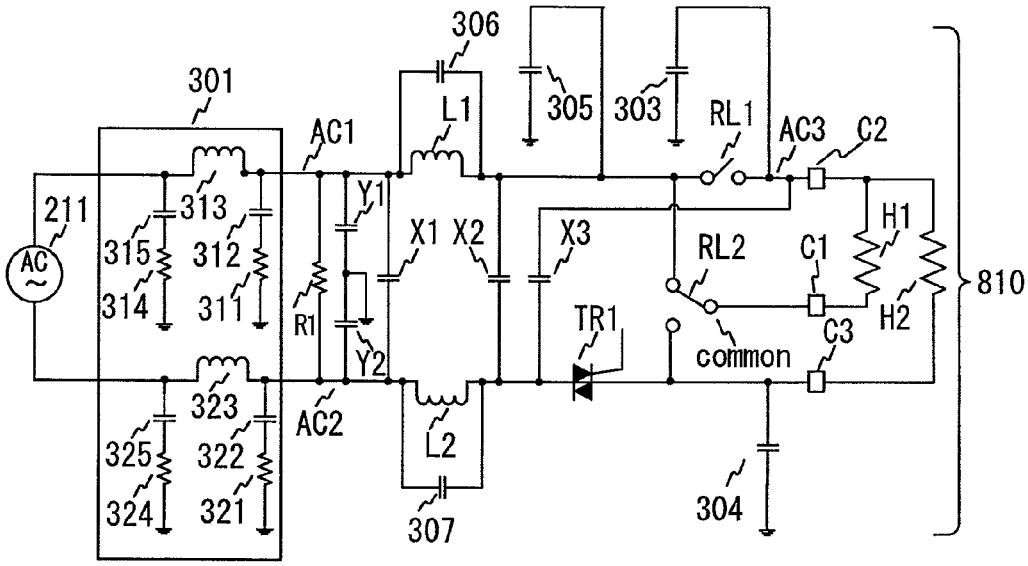
FIGS. 10A and 10B illustrates a heater control circuit used for measuring a noise terminal voltage in a third embodiment.
Figure 10B:
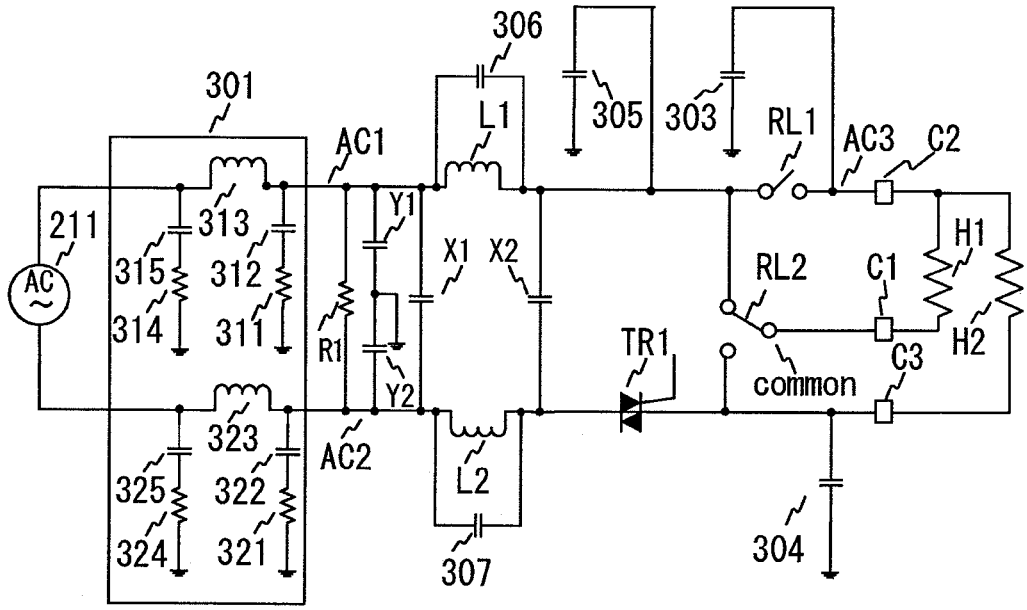

FIGS. 10A and 10B are circuit diagrams for use in simulated measurement of a noise terminal voltage to describe the effects of the capacitor X3 suppressing noise of the noise terminal voltage, the capacitor X3 being disposed in the control circuit 810 of the present embodiment. FIG. 10A is a circuit diagram including the capacitor X3, and FIG. 10B is a circuit diagram excluding the capacitor X3. Note that the stray capacitors 303 to 305 have the same capacitance, and the parasitic capacitors 306 and 307 of the inductors L1 and L2 each have 20 times the capacitance of the stray capacitors 303 to 305 respectively.

[Measurement Results of Noise Terminal Voltage]

FIGS. 11A to 11E illustrate the results of measuring the noise terminal voltage of the control circuit 810 illustrated in FIG. 10A. FIGS. 11F to 11J illustrate the results of measuring the noise terminal voltage of the control circuit 810 illustrated in FIG. 10B.

Figure 11A:
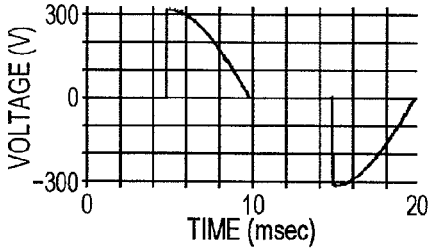
FIGS. 11A, 11B, 11C, 11D, 11E, 11F, 11G, 11H, 11I and 11J illustrate a measured waveform of a noise terminal voltage of the heater control circuit of the third embodiment.
Figure 11F:
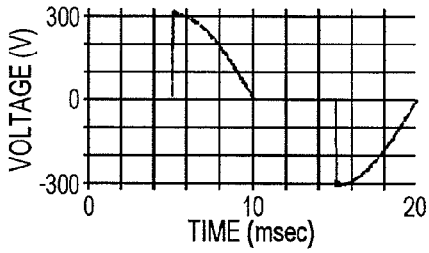

FIGS. 11A and 11F are a waveform diagram of the voltages applied to the respective heating patterns H1 and H2 of the heater 800 in a cycle (20 msec) of the commercial power supply 211 in the circuits in FIGS. 10A and 10B. Each waveform diagram illustrates a waveform in a state of being phase-controlled to a duty cycle of 50% by the triac TR1. Hereinafter, noise occurring at a positive phase control timing (at 5 msec) will be described. Noise occurring at a negative phase control timing (at 15 msec) produces the same results as at the positive phase control timing though the phase is inverted 180°, and thus the description is omitted.

Figure 11B:
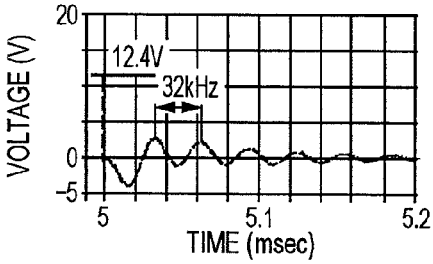

FIG. 11B illustrates a waveform of a voltage (noise component detected by noise terminal voltage measurement) applied to the resistor 311 of the LISN 301 in FIG. 10A at a timing (at 5 msec in FIG. 11A) when the triac TR1 is phase-controlled. It is understood from FIG. 11B, that a 12.4-V sudden surge noise voltage occurs at a timing when the triac TR1 is turned on, and then about 32-kHz resonance noise occurs. FIG. 11C illustrates a waveform of a voltage (noise component detected by noise terminal voltage measurement) applied to the resistor 321 of the LISN 301 in FIG. 10A at a timing (at 5 msec in FIG. 11A) when the triac TR1 is phase-controlled. It is understood from FIG. 11C, that a 12.4-V sudden surge noise voltage occurs at a timing when the triac TR1 is turned on, and then about 32-kHz LC resonance noise occurs.

Figure 11G:
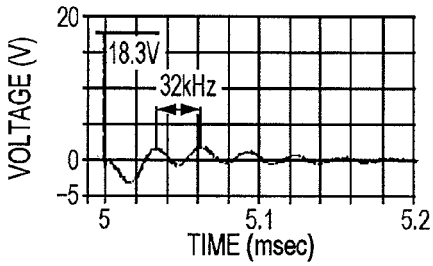
Figure 11C:
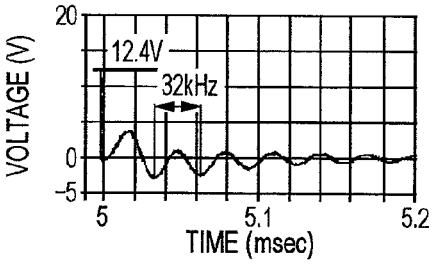
Figure 11H:
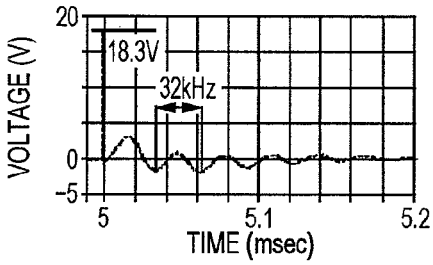

FIG. 11G illustrates a waveform of a voltage (noise component detected by noise terminal voltage measurement) applied to the resistor 311 of the LISN 301 in FIG. 10B at a timing (at 5 msec in FIG. 11F) when the triac TR1 is phase-controlled. It is understood from FIG. 11G, that a 18.3-V sudden surge noise voltage occurs at a timing when the triac TR1 is turned on, and then about 32-kHz resonance noise occurs. FIG. 11H illustrates a waveform of a voltage (noise component detected by noise terminal voltage measurement) applied to the resistor 321 of the LISN 301 in FIG. 10B at a timing (at 5 msec in FIG. 11F) when the triac TR1 is phase-controlled. It is understood from FIG. 11H, that a 18.3-V sudden surge noise voltage occurs at a timing when the triac TR1 is turned on, and then about 32-kHz resonance noise Occurs.

It is understood from FIGS. 11B, 11C, 11G, and 11H that in comparison with the simulated measurement results of the common mode surge noise components detected by measurement of the noise terminal voltages applied to the resistors 311 and 321 of the LISN 301 in FIGS. 10A and 10B, the surge noise component in FIG. 10B is larger than that in FIG. 10A. Since the control circuit 810 of the present embodiment adds the inductor L2 to the control circuit 210 of the first embodiment, the surge noise components illustrated in FIGS. 10A and 10B are lower than those in the first embodiment. It is understood that an additional use of the capacitor X3 further can reduce the sudden noise component.

Figure 11D:
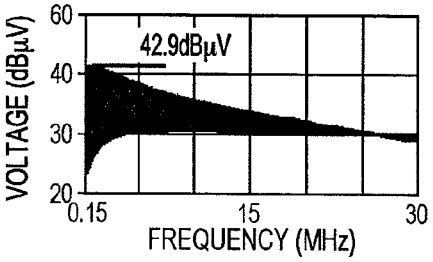

FIG. 11D illustrates the results that a voltage (noise component detected by noise terminal voltage measurement) applied to the resistor 311 of the LISN 301 in FIG. 10A is subjected to Fast Fourier Transform. It is understood from FIG. 11D that the noise component at a low frequency region near 150 kHz is the largest, namely, about 42.9 dBμV. FIG. 11E illustrates the results that a voltage (noise component detected by noise terminal voltage measurement) applied to the resistor 321 of the LISN 301 in FIG. 10A is subjected to Fast Fourier Transform. It is understood from FIG. 11E that the noise component at a low frequency region near 150 kHz is the largest, namely, about 42.9 dBμV.

Figure 11I:
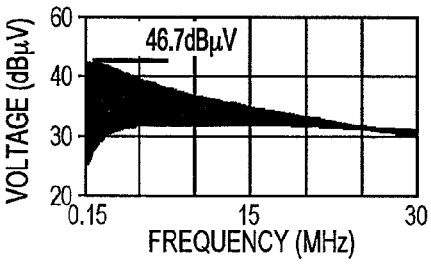
Figure 11E:
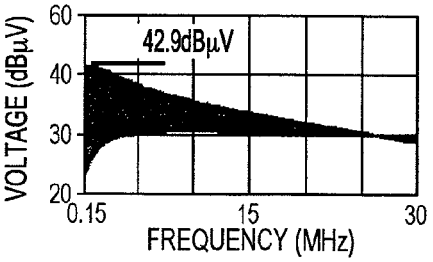
Figure 11J:
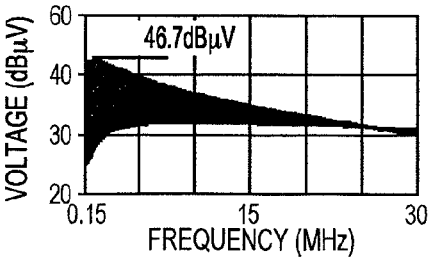

FIG. 11I illustrates the results that a voltage (noise component detected by noise terminal voltage measurement) applied to the resistor 311 of the LISN 301 in FIG. 10B is subjected to Fast Fourier Transform. It is understood from FIG. 11I that the noise component at a low frequency region near 150 kHz is the largest, namely, about 46.7 dBμV. FIG. 11J illustrates the results that a voltage (noise component detected by noise terminal voltage measurement) applied to the resistor 321 of the LISN 301 in FIG. 10B is subjected to Fast Fourier Transform. It is understood from FIG. 11J that the noise component at a low frequency region near 150 kHz is the largest, namely, about 46.7 dBμV.

It is understood from the comparison of the measurement results of the noise terminal voltage using the circuits illustrated in FIGS. 10A and 10B that in FIG. 10A, the peak voltage of surge noise is suppressed to 12.4 V which is lower than the peak voltage 18.3 V of surge noise in FIG. 10B. Sharp surge noise with a short pulse width contains high frequency component noise. The higher the peak voltage of the surge noise, the higher the noise component of 150 kHz to 30 MHz. The about 32-kHz LC resonance noise occurring in the control circuit 810 of the present embodiment has a frequency lower than a lower cutoff frequency (150 kHz) for measuring the noise terminal voltage, and thus less affects the noise measurement of the noise terminal voltage.

As described hereinbefore, in comparison with the circuit excluding the capacitor X3, the circuit including the capacitor X3 can suppress the peak voltage of surge noise occurring when the triac TR1 is turned on and thus can reduce the noise component of 150 kHz to 30 MHz.

Meanwhile, if the inductors L1 and L2 are ideal coils without a parasitic capacitance component, even the configuration excluding the capacitor X3 illustrated in FIG. 10B generates almost no surge noise described in FIGS. 11A to 11J. In fact, most real coils have a parasitic capacitance component larger than a stray capacitance. Thus, when the inductors L1 and L2 have a parasitic capacitance larger than the stray capacitance of the substrate, the inductors L1 and L2 prevent the effects of reducing surge noise described in FIGS. 11A to 11J. Thus, even in the configuration of the control circuit 810 including the two inductors L1 and L2, the use of the capacitor X3 can suppress an increase in noise level of the noise terminal voltage by performing power control on the heater.

Further, examples of the method of reducing noise include not only the method of including the inductor L2 described in the present embodiment but also a method of including a common mode choke coil. However, a large current generally flows into an image heating apparatus for use in an image forming apparatus, which often causes a problem with heating by the inductor. The coil having a large inductance component and capable of passing a large current is often expensive and large in component size. Thus, use of many inductors causes an increase in size of the apparatus and an increase in cost thereof. Further, most inductors such as coils have a parasitic capacitance component. As described in the present embodiment, if the parasitic capacitance component of the coil is larger than the stray capacitance causing noise, the effects of reducing high frequency surge noise described in FIGS. 6A to 6J are hardly obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-151148, filed Jul. 1, 2010, which is hereby incorporated by reference herein in its entirety.

What is claimed is:

1. An image heating apparatus comprising:

a first heat generation member that heats up by power supplied from a commercial power supply, the first heat generation member being connected between a first connector and a second connector;

a second heat generation member that heats up by power supplied from the commercial power supply, the second heat generation member beings connected between the second connector and a third connector;

a drive element that controls power supplied to the first heat generation member and the second heat generation member;

a connection state switching section that switches the first heat generation member and the second heat generation member between a serial connection state and a parallel connection state, the connection state switching section including a make contact relay or a break contact relay having a first contact connected to a first power terminal of the commercial power supply and a second contact connected to the second connector, and a transfer-contact relay having a common contact connected the first connector, a first contact connected to the first power terminal side of the commercial power supply and a second contact connected to the drive element;

wherein a power supply path extending from the first power terminal of the commercial power supply is branched off into the first contact of the make contact relay or the break contact relay and the first contact of the transfer-contact relay, wherein the power supply path extending from the second power terminal of the commercial power supply is branched off into the second contact of the transfer relay and the third connector through the drive element, and a capacitor connected between a circuit line of the power supply path between the second contact of the make contact relay or the break contact relay and the second connector and the second power terminal of the commercial power supply.

2. An image heating apparatus according to claim 1, further comprising an endless belt, a heater having the first heat generation member and the second heat generation member and contacting an inner surface of the endless belt, and a nip portion forming member forming a fixing nip portion with the heater, through the endless belt, that conveys and heats a recording material that bears an image.

3. An image heating apparatus according to claim 1, further comprising a voltage detection part for detecting a voltage of the commercial power supply, wherein the connection state switching section switches the first heat generation member and the second heat generation member between a serial connection sate and a parallel connection state in accordance with the voltage detected by the voltage detection part.

4. An image heating apparatus according to claim 1, wherein the drive elements includes a triac.

5. An image heating apparatus according to claim 1, wherein the commercial power supply supplies a voltage with a phase-controlled waveform into the first and second heat generation member.

* * * * *